United States Patent [19]

Miyoshi et al.

[11] 4,147,426

[45] Apr. 3, 1979

[54] ELECTROSTATIC PHOTOGRAPHIC COPYING MACHINE

[75] Inventors: Hideo Miyoshi, Habikino; Kiyoshi Shibata, Osaka; Shogo Fukuoka, Kobe; Tatsuo Aizawa, Osaka, all of Japan

[73] Assignee: Mita Industrial Company, Ltd., Osaka, Japan

[21] Appl. No.: 802,530

[22] Filed: Jun. 1, 1977

[30] Foreign Application Priority Data

| | | | |
|---|---|---|---|
| Jun. 2, 1976 | [JP] | Japan | 51-65078 |
| Jun. 2, 1976 | [JP] | Japan | 51-65079 |
| Jun. 5, 1976 | [JP] | Japan | 51-72675[U] |
| Jul. 17, 1976 | [JP] | Japan | 51-96018[U] |
| Aug. 7, 1976 | [JP] | Japan | 51-94269 |
| Aug. 23, 1976 | [JP] | Japan | 51-100800 |

[51] Int. Cl.[2] ..... G03G 15/22

[52] U.S. Cl. ..... 355/3 SH; 271/64; 355/3 DD; 355/3 DR; 355/11; 355/16; 355/69

[58] Field of Search ..... 271/64, 65; 355/3 R, 355/3 FU, 3 SH, 11, 50, 51, 66, 67, 71, 3 DD, 3 DR, 69

[56] References Cited

U.S. PATENT DOCUMENTS 3,860,339 1/1975 Bendall ..... 271/64 X

*Primary Examiner*—A. D. Pellinen

*Attorney, Agent, or Firm*—Wenderoth, Lind & Ponack

[57] ABSTRACT

An electrostatic photographic copying machine includes a photosensitive body having a photosensitive layer on its surface, a charging apparatus, a developing device and a transfer device arranged along a moving passage of the photosensitive body. An optical system projects an image of an original onto the surface of the charged photosensitive body, and a fixation apparatus fixes a transferred image onto copying paper. The electrostatic photographic copying machine is provided with an original paper inserting port, an original paper carrying passage, a first original paper discharging port for discharging the original paper in a forward direction, a second original paper discharging port for discharging the original paper in a rearward direction, a copying paper supplying apparatus, copying paper carrying passages, a first copying paper discharging port for discharging the copying paper in a forward direction, a second copying paper discharging port for discharging the copying paper in a rearward direction, and changing mechanism for changing the directions of movement of the original paper and the copying paper to the forward and rearward directions thereof, respectively.

26 Claims, 21 Drawing Figures

123A
127
127A
127b
127b
115a
131a
131
102
102a
126A
115A
120
119A
134a
134A
128a
115a
133
116B
116A
123B
125B
130
129
117
128
116a
119B
13
115B
121
122
115b

ELECTROSTATIC PHOTOGRAPHIC COPYING MACHINE

BACKGROUND AND SUMMARY OF THE INVENTION

The present invention relates to an electrostatic photographic copying machine.

An object of the present invention is to provide an electrostatic photographic copying machine which is constituted so as to selectively carry original paper and copying paper in forward or rearward directions without having intersection between the original paper carrying passage and the copying paper carrying passage, whereby the discharging ports for the original paper and the copying paper can be selected at will, depending on the size of the original paper and the quality of the paper.

Another object of the present invention is to provide such an electrostatic photographic copying machine which is provided with a master case, whereby it is possible to exchange a photosensitive layer simply and easily.

A further object of the present invention is to provide such an electrostatic photographic copying machine which is provided with a copying paper supplying apparatus that can easily perform the operation of setting and exchanging copying paper, without the occurrence of slipping of the copying paper during insertion or withdrawal of a paper supplying table.

A further object of the present invention is to provide such an electrostatic photographic copying machine which is provided with a development apparatus that can supply toner evenly throughout the entire width of a magnetic brush roller, without the occurrence of uneven development.

A further object of the present invention is to provide such an electrostatic photographic copying machine with which it is possible to achieve exact magnification.

A further object of the present invention is to provide such an electrostatic photographic copying machine which is provided with an exposing apparatus with which it is possible to perform copying evenly and clearly throughout the entire width of the copying paper, even when the copying paper has a particularly large width.

A still further object of the present invention is to provide such an electrostatic photographic copying machine which can easily perform copying of both normal images and reverse images.

Other objects and features of the present invention will become apparent from the following description of one practical embodiment of the invention, with reference to the accompanying drawings.

DETAILED DESCRIPTION OF THE PREFERRED EMBODIMENT

Figure 1:
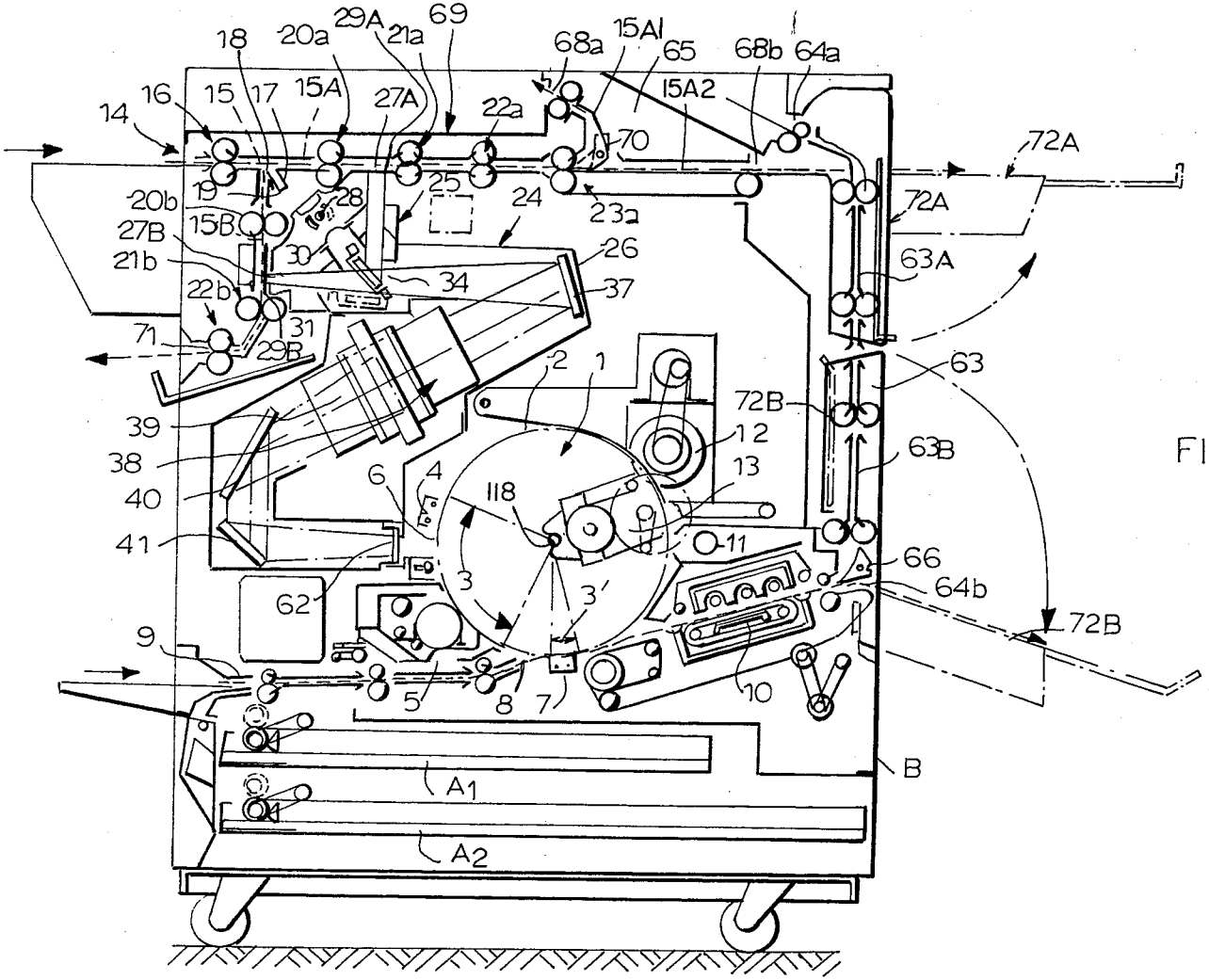
FIG. 1 is a longitudinal sectional view showing the overall construction of an electrostatic photographic copying machine according to the present invention.

FIG. 1 shows the overall construction of the electrostatic photographic copying machine according to the present invention, and in the drawing, numeral 1 is a rotary type photosensitive body on the surface of which is attached an electrostatic photographic photosensitive layer (e.g. master paper) 2. Image-forming zone 3 and transfer zone 3' are provided along the rotary path of movement of photosensitive body 1. A charging means 4 and developments means 5 are arranged at image-forming zone 3, and exposing part 6 to project a light-image from an optical system (to be described later) onto the photosensitive layer 2 at the surface of photosensitive body 1 is provided between these means 4 and 5. A transfer means 7 to transfer the image from photosensitive layer 2 onto copying paper is provided at the transfer zone 3', and a copying paper carrying passage (shown generally at 8) is provided adjacent the outer periphery of photosensitive body 1 at transfer zone 3'. Copying paper inserting port 9 is provided at the inlet end of copying paper carrying passage 8, and multiple kinds, e.g. two kinds, of copying papers are supplied automatically and selectively by respective copying paper supplying devices $A_1$, $A_2$. Alternatively, suitable copying paper may be inserted into paper inserting port 9 from the exterior by hand. Fixing means 10 to apply a fixing treatment to fix the toner image onto the copying paper after transfer thereto of the image is provided adjacent the discharge side of the copying paper carrying passage 8. A discharging lamp 11 exposes the entire surface of the photosensitive layer of the exposed image uniformly. Also provided are cleaning means 12 and master case 13 for winding up both end parts of the photosensitive layer 2 attached to the surface of the photosensitive body 1.

Original paper to be copied is fed from inserting port 14 for original paper into an original paper carrying passage 15 connected with port 14 by a pair of carrying rollers 16. This original paper carrying passage 15 is branched to normal image copy carrying passage 15A extending horizontally and reverse image copy carrying passage 15B extending vertically downwardly, and carrying passage changing means 17 is provided at the branch of passages 15A and 15B so as to guide the original paper fed into the carrying passage 15 from the inserting port 14 toward a desired carrying passage 15A or 15B. This carrying passage changing means 17 comprises an angle-shaped member 19 fixed by a rotary shaft 18 at its center part, and member 19 may be turned by a solenoid (not shown). Multiple pairs of carrying rollers 20*a*, 21*a*, 22*a* and 23*a* and 20*b*, 21*b* and 22*b* are provided along the normal image copy carrying passage 15A and the reverse image copy carrying passage 15B, respectively.

Numeral 24 is an optical system which is received in first separated chamber 25 and second separated chamber 26. Irradiating openings 27A and 27B are provided in the first separated chamber 25 at sides facing the normal image copy carrying passage 15A and the reverse image copy carrying passage 15B, respectively, and a light source 28 is provided at a central position on a line connecting openings 27A and 27B. Exposing glasses 29A and 29B are positioned at the openings 27A and 27B, respectively, and the original paper carried along the normal image copy carrying passage 15A and the reverse image copy carrying passage 15B passes along outer surfaces of glasses 29A and 29B, respectively. Light from light source 28 is irradiated onto the original paper passing through the normal image copy carrying passage 15A or the reverse image copy carrying passage 15B through irradiating openings 27A or 27B and exposing glasses 29A or 29B, respectively.

Figure 2:
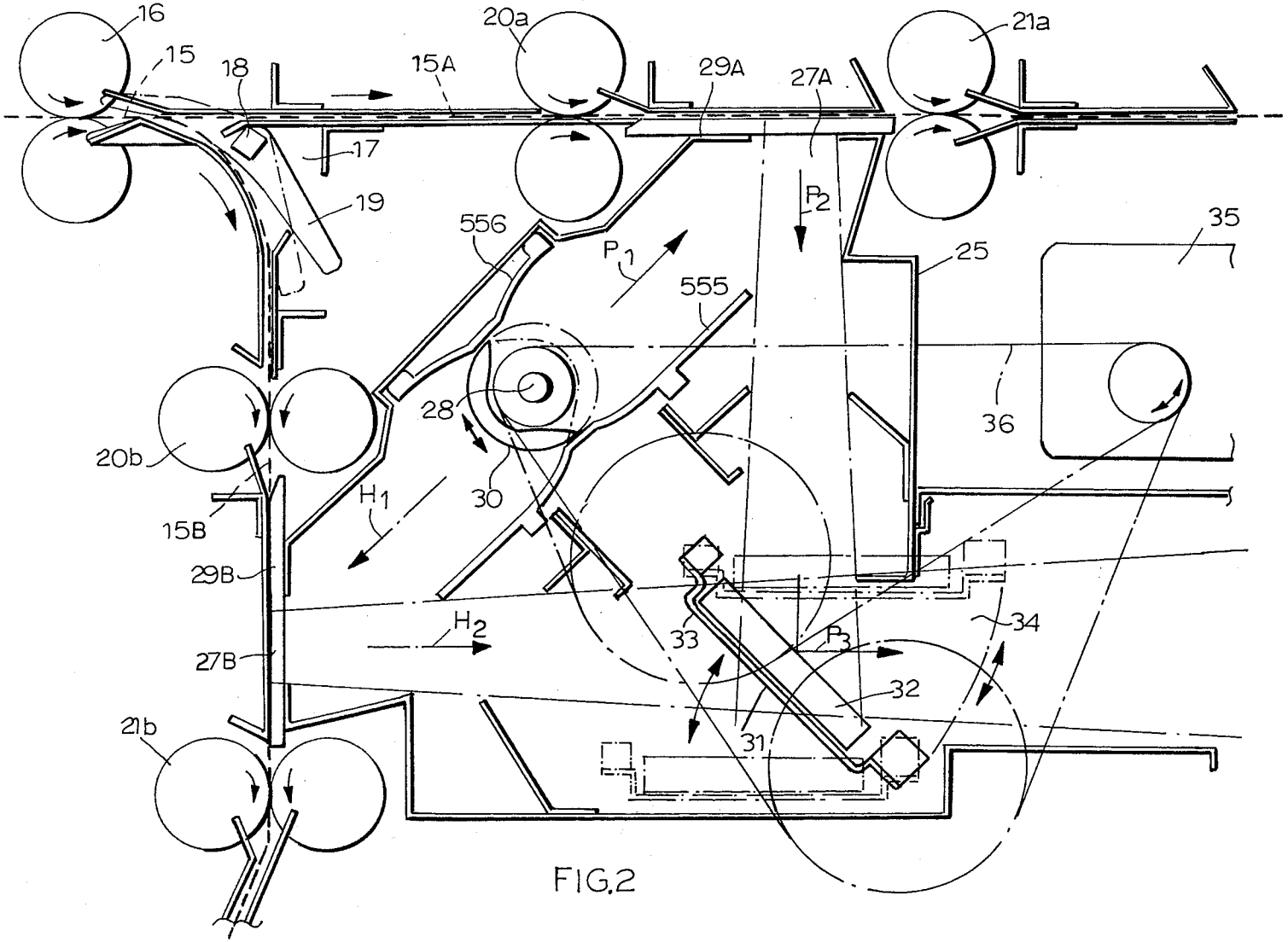
FIG. 2 is a partially enlarged view of a light path and original paper path structure of the apparatus of FIG. 1.

As shown in the enlarged view of FIG. 2, changing means for changing the path of irradiating light toward either desired position, i.e. toward irradiating opening 27A opened to the normal copy carrying passage 15A or toward irradiating opening 27B opened to the reverse copy carrying passage 15B, is provided at the light source 28. This means for changing the light path comprises, e.g., movable reflecting plate 30 having a circular arc section and supported for rotation in opposite directions about the light source 28.

When this movable reflecting plate 30 is positioned as shown by the solid line in FIG. 2, light passing toward the reverse image copy carrying passage 15B is intercepted, and the light from the light source 28 is irradiated only toward the normal image copy carrying passage 15A through the opening 27A and the exposing glass 29A. Conversely, when the movable reflecting plate 30 is turned into a position as shown by the imaginary line in FIG. 2, the light passing toward the normal image copy carrying passage 15A is intercepted, and the light path toward the reverse image copy carrying passage 15B is opened.

Further, in FIG. 2, numerals 555 and 556 are fixed reflecting plates.

This means for changing the light path may be other means, for example, a movable reflecting plate of U-shaped section, formed by a movable reflecting plate of circular arc shaped section and a fixed reflecting plate as one body, may be used so that it can irradiate light to openings 27A or 27B by changing its direction, or it may be made to perform irradiation of the normal image or the reverse image by providing two reflecting plates facing two light sources, as will be understood by a person skilled in the art.

Numeral 31 is means for selecting a normal or reverse light path and includes at one surface thereof a reflecting mirror 32 and at another surface thereof a shielding plate 33. Selecting means 31 is pivotally mounted about one end thereof. When means 31 is positioned as shown by the solid lines in FIG. 2, the light path for normal image copying is opened, and light discharged from the light source 28 and reflected within normal copy carrying passage 15A is reflected by mirror 32 and enters the second separated chamber 26 through communicating port 34 between the first separated chamber 25 and second separated chamber 26, as indicated by arrows $P_1$, $P_2$, $P_3$ in FIG. 2. When selecting means 31 is turned to the position shown by the dashed lines in FIG. 2, the normal image copying light path is intercepted, while the reverse image copying light path is opened, and light enters into the second separated chamber 26 through communicating port 34, as indicated by arrows $H_1$, $H_2$ in FIG. 2 (in this case, of course, it is necessary that the movable reflecting plate 30 be changed to the reverse position).

Further, selecting means 31 is not limited only to the above described structure means, but may be changed in design as will be understood by a person skilled in the art so that identical operation can be achieved by combination of an optical system such as a mirror. Selecting means 31 and the movable reflecting plate 30 are driven at the same time by a driving motor 35 and a belt 36. Namely, when the movable reflecting plate 30 is positioned as shown by the solid line in FIG. 2, selecting means 31 is also positioned as shown by the solid lines in the drawing, whereby the normal copying light path is opened while the reverse copying light path is closed. And, when the movable reflecting plate 30 is changed to the position shown by the dashed line in the drawing, selecting means 31 is also changed to the position of the dashed lines, whereby the reverse image copying light path is opened while the normal image copying light path is closed.

Further, although not shown in the drawings, solenoids which control operation of the carrying passage changing apparatus 17 are made to operate in connection with the driving motor 35. Accordingly, when e.g. the carrying passage changing apparatus 17 is operated so as to open normal image copy carrying passage 15A, the movable plate 30 and light path selecting means 31 are also operated by the driving motor 35 so as to open the normal image copying light path.

As described above and as shown in FIG. 1, the normal image copying light path or the reverse image copying light path formed within the first separated chamber 25 enters into second separated chamber 26 through communicating port 34, and the light first is reflected by mirror 37 positioned at the inlet side and then passes through 1-magnification lens 38 or reducing lens 39 (these lens 38 and 39 are constituted so that their positions can be changed freely in order to position either one within the light path by a mechanism not shown), and reflected by one pair of mirrors 40 and 41, and then projected through exposing opening 62 onto photosensitive layer 2 at image-forming zone 3 on the photosensitive body 1. Thus, the normal image or the reverse image of the original paper is focused.

For example, when the normal image copying light path is opened, the image of the copying original paper is projected onto photosensitive layer 2 in a reverse image configuration through the optical system, and when the reverse image copying light path is opened, it is projected onto photosensitive layer 2 in a normal image configuration.

Figure 3:
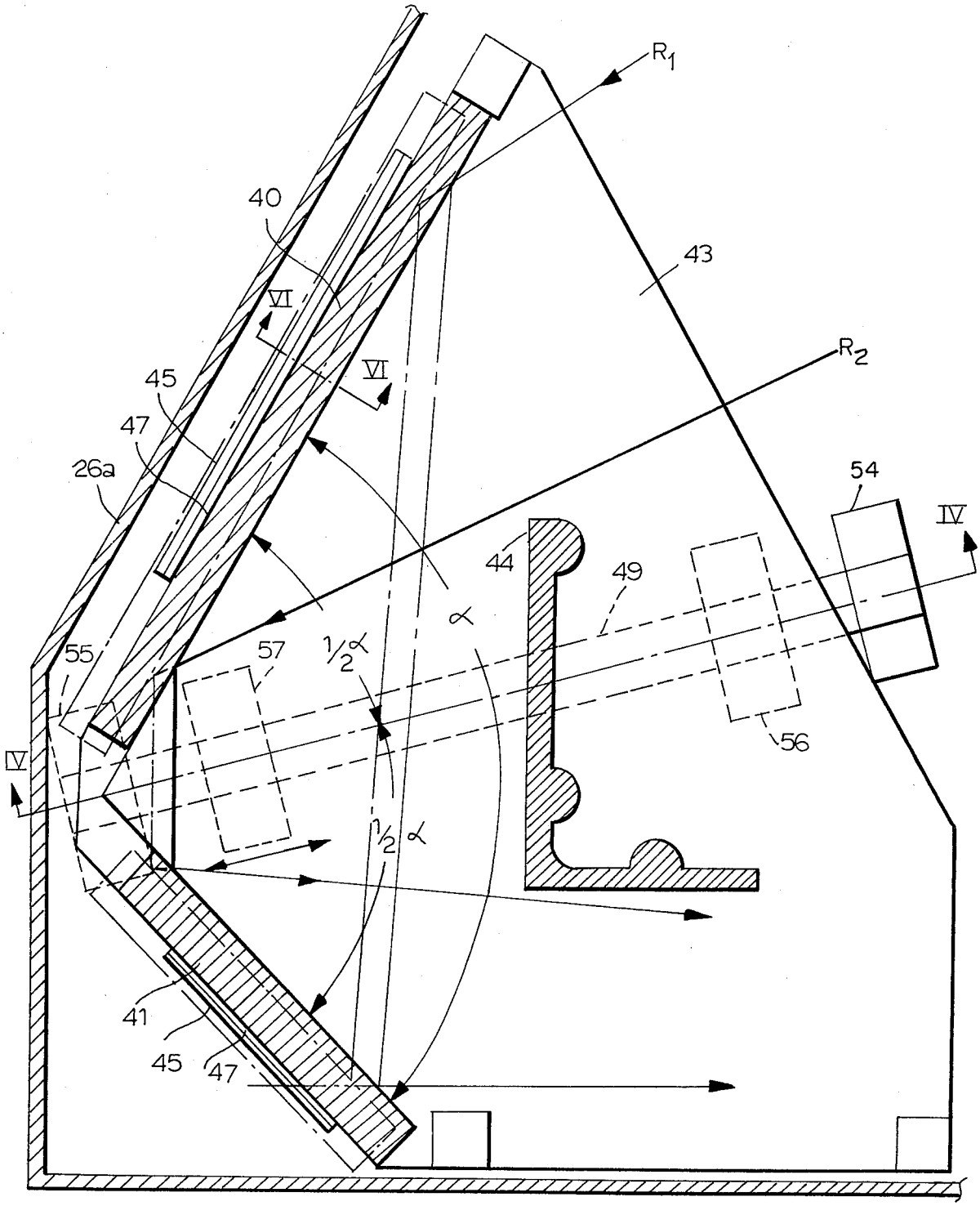
FIG. 3 is an enlarged partial view of a mirror structure of the apparatus of FIG. 1.
Figure 4:
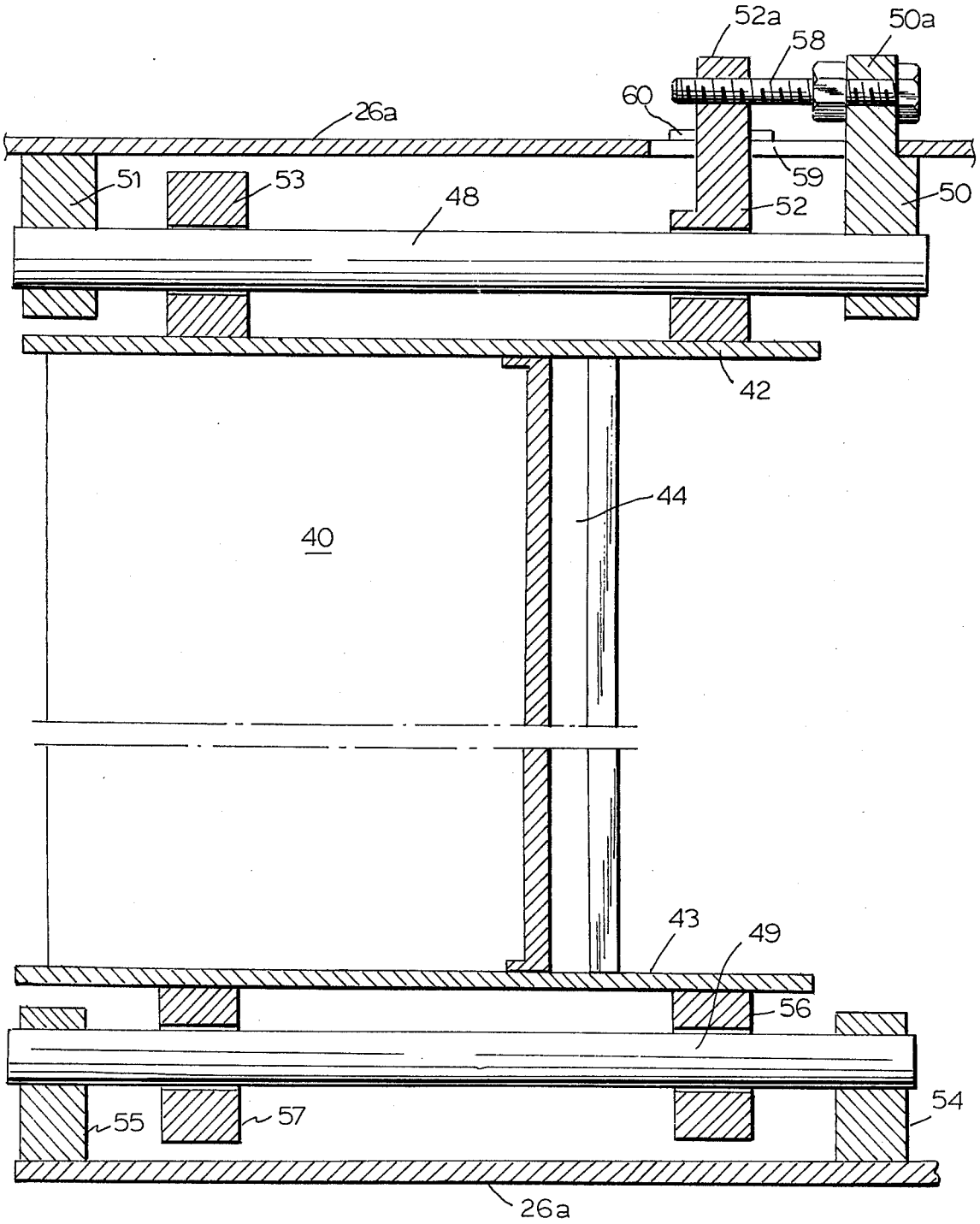
FIG. 4 is a sectional view taken substantially along lines IV—IV in FIG. 3.
Figure 5:
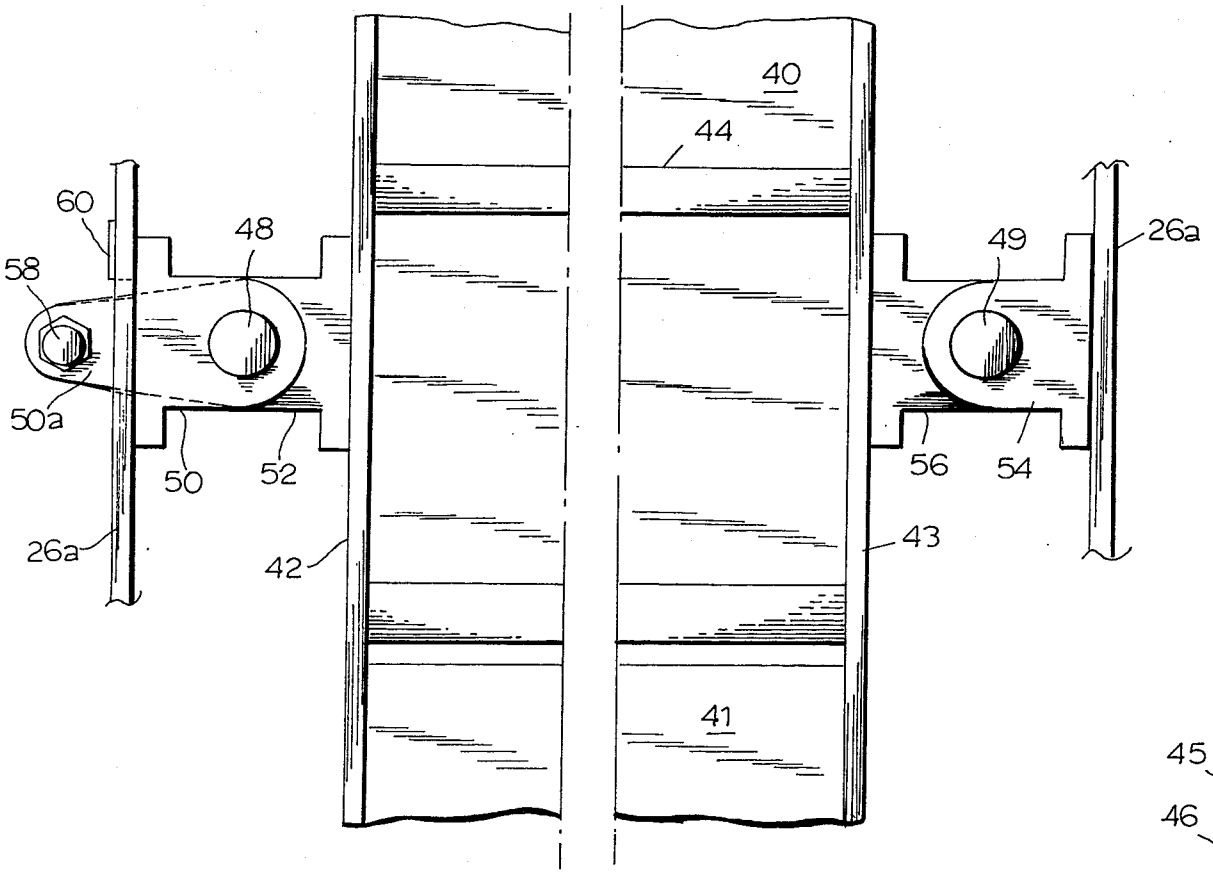
FIG. 5 is a side view of FIG. 3.
Figure 6:
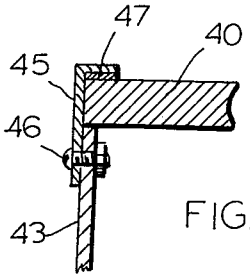
FIG. 6 is a sectional view taken substantially along lines VI—VI in FIG. 3.

The pair of mirrors 40 and 41 form angle $\alpha$, as shown in the enlarged view of FIG. 3, and they are fixed as one body to side plates 42 and 43 arranged within bulkhead body 26*a* of the second separated chamber 26. These side plates 42 and 43 are connected and fixed through a partition 44, as shown in FIGS. 4 and 5. The side plates 42 and 43 and the mirrors 40 and 41 are fixed by fastener 46 and a right-angled connector 45, as shown in FIG. 6 which illustrates the connection only of the mirror 40 and the side plate 43. Further, numeral 47 in FIG. 6 shows a packing.

As shown in FIG. 4 and FIG. 5, shafts 48 and 49 are positioned at the outside of plates 42 and 43 and are arranged on a plane positioned between mirrors 41 and 42 midway of angle $\alpha$. The shaft 48 is fixed to fixed brackets 50 and 51 attached to the bulkhead body 26*a* and is slidably supported by brackets 52 and 53 attached to the side plate 42. Shaft 49 is similarly fixed to fixed brackets 54 and 55 attached to the bulkhead body 26*a* and is slidably supported by brackets 56 and 57 attached to the side plate 43. A bolt 58 is screw-fitted parallel to shaft 48 through an outwardly extending part 50*a* of the fixed bracket 50 and an outwardly extending part 52*a* of the sliding bracket 52. Accordingly, the sliding bracket 52 is caused to slide along the shaft 48 by turing bolt 58, whereby the side plates 42 and 43 and the mirrors 40 and 41 fixed thereto can be moved back and forth along a plane positioned midway between the planes of the mirrors.

Outwardly extending parts 50*a* and 52*a* of the fixed bracket 50 and the sliding bracket 52 extend outwardly of the bulkhead body 26*a* so that operation of the bolt 58 can be performed from outside of the bulkhead body 26*a*. Part 52*a* of the sliding bracket 52 is slidable within an opening 59 formed in the bulkhead body 26*a*, and a graduated plate 60 is provided along an edge of opening 59. An indication line (not shown) is provided on the sliding bracket 52, whereby the amount of movement of the sliding bracket 52 can be detected and the amount of movement of the mirrors 40 and 41 can also be detected.

Accordingly, assume that light $R_1$, $R_2$ advances in the directions shown by the solid lines toward exposing opening 62 when the mirrors 40 and 41 are set in the positions shown by the solid lines in FIG. 3. Then if the mirrors 40 and 41 are moved forward to the positions of the dashed lines by moving the side plates 42 and 43 along the shafts 48 and 49 by operation of the bolt 58, the light $R_1$, $R_2$ is reflected from mirror 40 at the same angle as was the case before moving the mirrors, and the length of the light path is increased at mirror 40 by the amount of movement of the mirror. At mirror 41, the length of the light path is also increased and the light is reflected at the same angle as was the case before moving the mirrors. The light then advances toward opening 62 via the same light path as was the case before moving the mirrors. If the mirrors 40 and 41 are moved rearwardly, the length of the light path is correspondingly shortened. Thus, the length of the light path can be increased or decreased by moving the sliding brackets 52 and 53, the side plates 42 and 43 and the mirrors 40 and 41 by operation of the bolt 58. Accordingly, by moving the sliding bracket 52 by an amount indicated by graduation plate 60, and by thus moving mirrors 40 and 41 by a corresponding amount, the length of the light path may be changed, and correction of an error of the lens can be easily performed. Further, in the above described practical example the construction is such that both the left and right sides of the mirrors 40 and 41 are moved at the same time along the shafts 48 and 49 parallel to the side plates 42 and 43. However, any other mechanism may be used as long as the mirrors are constructed so as to be movable along a plane positioned midway between the angle included between the planes of the mirrors. Further, although the pair of mirrors 40 and 41 are shown as provided between the lens 38 or 39 and the exposing opening 62, the mirrors can be provided between the irradiating opening and lens.

In this electrostatic photographic copying machine, one pair of mirrors are provided to irradiate light from the light source onto the photosensitive body, and such one pair of mirrors are constructed to be movable as one body along a plane midway between the angle included between the planes of the mirrors. Accordingly, the length of the light path can be simply changed to correct for error of the lens, and exact magnification of the image can be achieved.

In this copying machine, the original paper carrying passage is branched into a normal image copy carrying passage and a reverse image copy carrying passage, and the carrying passage changing apparatus to guide the original paper toward either desired carrying passage is provided. An irradiating light path changing means is provided to irradiate light from the light source of the optical system toward either of the irradiating opening in the normal image copy carrying passage or the irradiating opening in the reverse image copy carrying passage. Further, the means for selecting the normal or reverse light path is provided. Accordingly, normal image copying or reverse image copying can be performed merely by operation of the carrying passage changing apparatus, the irradiating light path changing means and the normal or reverse light path selecting means. These operations can be performed by a single operation if the respective apparatus and means are operatively related to each other. Also, construction is simplified by such arrangement, e.g. it is sufficient to provide only one light source and one original paper inserting port, and thus the overall shape of the copying machine becomes compact without occupying excessive space.

The reverse image or normal image transferred through the exposing opening 62 onto photosensitive layer 2 is moved in accordance with rotation of the photosensitive body 1 and is then developed by developing device 5 (to be described later), after which, it is transferred by a transfer device 7 onto the copying paper supplied along the copying paper carrying passage 8 at transfer zone 3'. Then, a fixing treatment is applied by fixing means 10 to the copying paper to which transfer of the image has been made, and when the copying paper is comparatively short, it is carried to a copying paper carrying passage 63 extending vertically upwardly from the discharge end of the fixing means 10, and is discharged onto a front copying paper receiver 65 from a first copying paper discharing port 64*a* at the upper end of carrying passage 63. A direction changing mechanism 66 for the copying paper carrying passage is provided at the discharge end of the fixing means 10, and when the copying paper is comparatively long, it can be discharged from second copy discharging port 64*b* by operation of changing mechanism 66.

Figure 7:
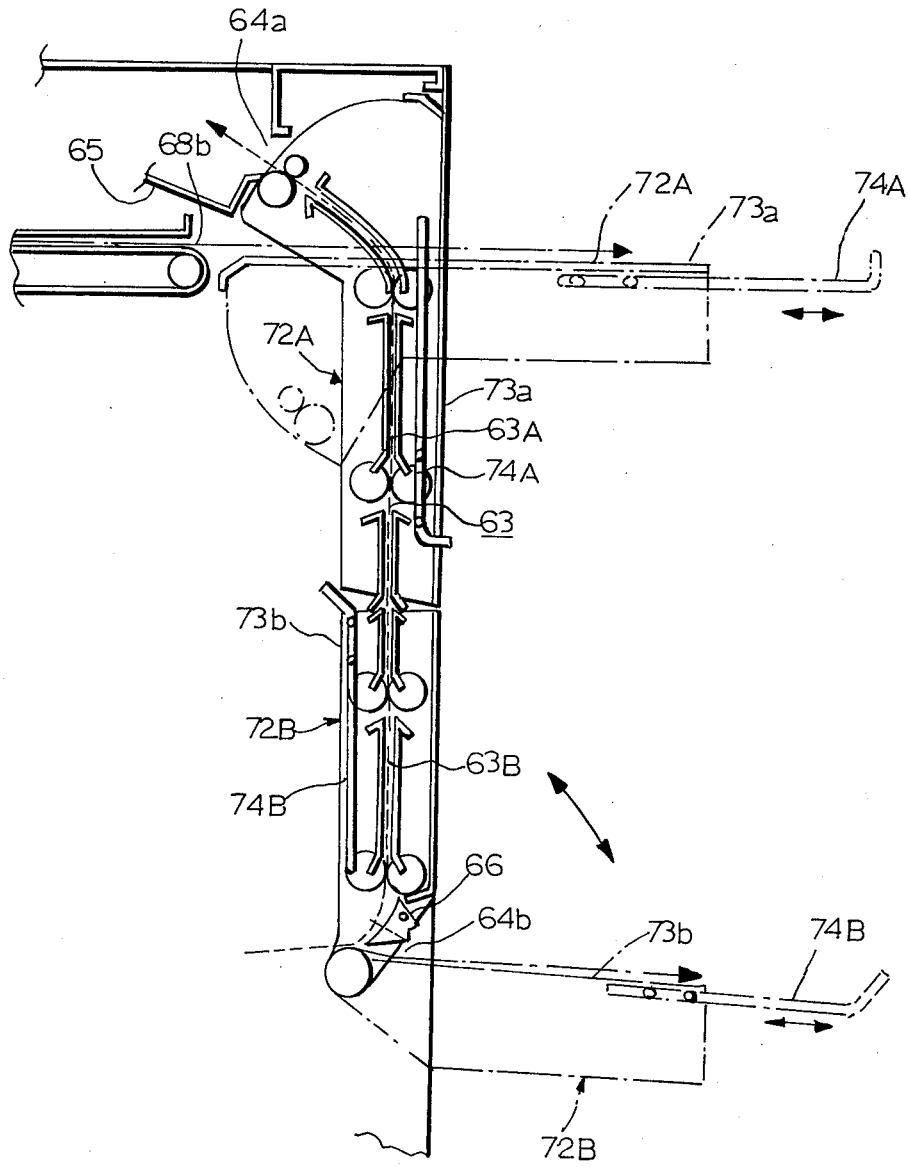
FIG. 7 is an enlarged view of a selecting apparatus for the carrying passage of the apparatus of FIG. 1.

As shown in FIG. 7, the copying paper carrying passage 63 is divided into an upper carrying passage 63A and a lower carrying passage 63B, and carrying passages 63A and 63B are received in two oscillating bodies 72A and 72B, respectively. Oscillating bodies 72A and 72B are constructed so that they can be opened and closed in an oscillatory manner around fulcrums on respective ends opposite to mutually opposed ends thereof. A rear original paper receiver 73*a* and a rear copying paper receiver 73*b* are formed on the outside side or face of oscillating body 72A and on the inside side or face of oscillating body 72B, respectively. A rear original paper receiving table 74A and a rear copying paper receiving table 74B which can be extended rearwardly from rear original paper receiver 73*a* and rear copying paper receiver 73*b*, respectively, are attached to oscillating bodies 72A and 72B, respectively, so as to be slidably movable to extended or contracted positions. In FIG. 1 and FIG. 7, the closed positions of the oscillating bodies 72A and 72B are shown by solid lines, and at these positions upper carrying passage 63A and lower carrying passage 63B are in alignment and communication. The dashed lines in the drawings show the open positions of the oscillating bodies 72A and 72B, and the upper and lower carrying passages 63A and 63B are separated from each other.

The rear part of the normal image copy carrying passage 15A of the original paper carrying page is branched to two carrying passage portions 15A1 and 15A2. Original paper of comparatively short length and soft nature is discharged into a first original paper receiver 69 through a first original paper discharging port 68*a* on detouring carrying passage portion 15A1 extending in a U-shaped fashion after finishing of irradiation of the original paper. A direction changing mechanism 70 is provided at the inlet to detouring carrying passage portion 15A1, and this mechanism 70 is set so as to normally open detouring carrying passage portion 15A1 as shown in FIG. 1. In the case of original paper of long length or of unbending nature, the inlet to detouring carrying passage portion 15A1 is closed by operation of mechanism 70, and the straight carrying passage portion 15A2 is opened, whereby the original paper is discharged rearwardly through carrying passage portion 15A2.

When straight carrying passage portion 15A2 is used by closing the detouring carrying passage portion 15A1, the rear original paper receiver 73*a* is positioned to be connected with the straight carrying passage portion 15A2 by moving oscillating bodies 72A and 72B to the positions shown by the dashed imaginary lines, and original paper is discharged onto the rear original paper receiver 73*a* and further onto the rear original paper receiving table 74A from a second original paper discharging port 68*b* at the rear end of the carrying passage portion 15A2.

Further, original paper carrying direction changing mechanism 70 and the copying paper carrying direction changing mechanism 66 can be arranged to move in cooperation with the opening and closing operations of oscillating bodies 72A and 72B, either mechanically or electrically.

When a second original is produced, the original paper is carried through the reverse image copy carrying passage 15B, and is removed from a discharging port 71 after completion of irradiation at the irradiating opening 27B.

As explained above, at least two oscillating bodies each include one part of a copying paper carrying passage, and the oscillating bodies are positioned such that the parts of the copying paper carrier passage communicate when copying paper is carried toward a first copying paper discharging port through the communicated parts of the carrying passage, and original paper is carried toward a first original paper discharging port when the oscillating bodies are so positioned. Copying paper is discharged rearwardly and is guided by one oscillating body, and original paper is discharged rearwardly and guided by another oscillating body when the oscillating bodies are positioned such that the parts of the carrier passage are not communicated. Thus, original paper and copying paper may be carried selectively, depending on the sizes and the properties of the paper, in a forward direction or a rearward direction, without the original paper carrying passage and the copying paper carrying passage intersecting each other, by changing the positions of the carrying direction changing mechanism and the oscillating bodies.

Especially, since the carrying direction changing mechanism and the oscillating bodies may be operated mechanically, the construction is simple, the manufacturing cost is low, and moreover repair and inspection of the interior of the copying machine can be performed easily by opening the oscillating bodies. Since the rear original paper receiver and the rear copying paper receiver are formed on respective faces of at least two oscillating bodies each forming one part of the copying paper carrying passage, there is no need for providing separate special original paper receiver and copying paper receiver structure, as is necessary in the pr or art. Accordingly, the apparatus of the invention is compact.

Figure 8:
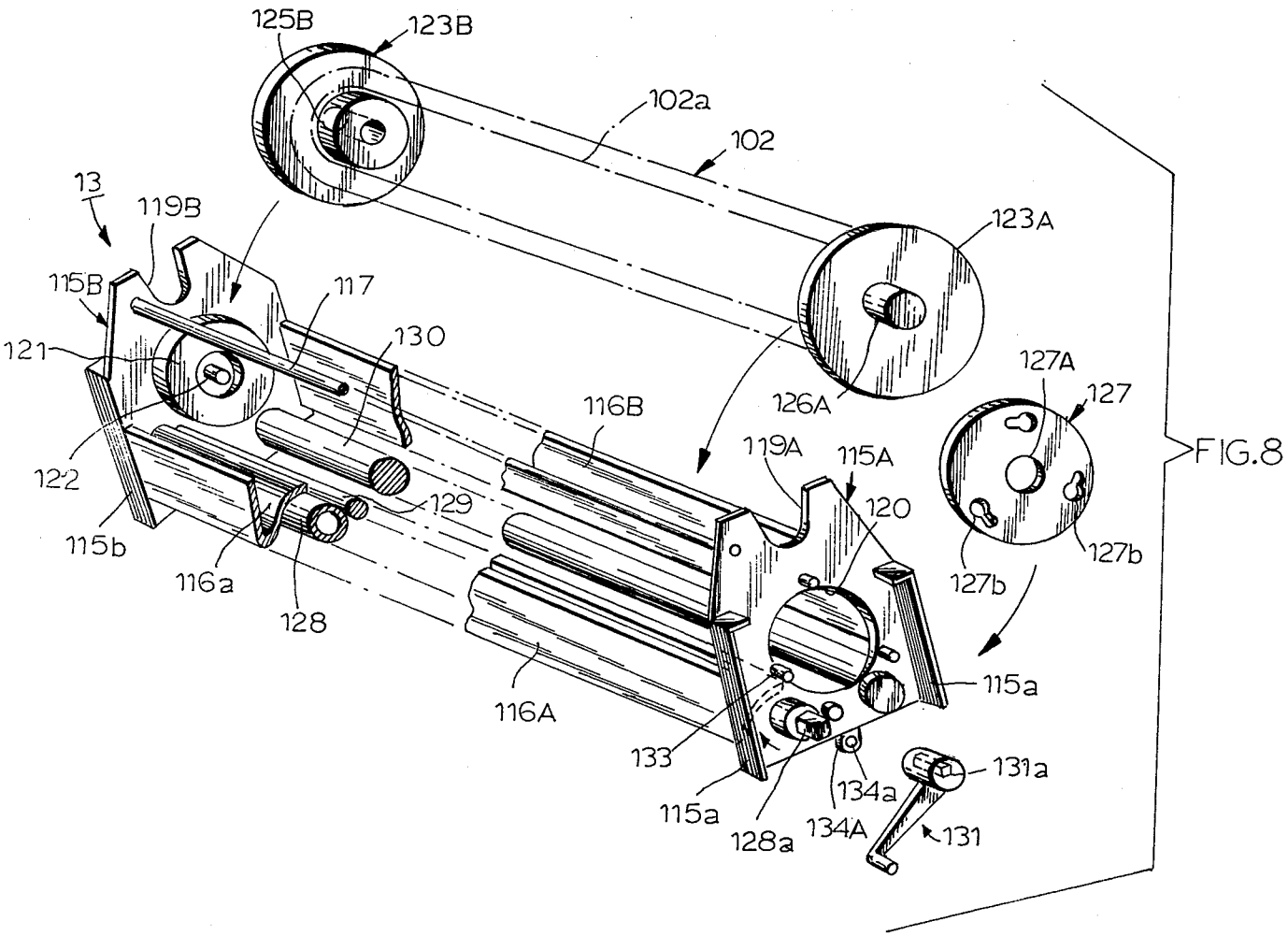
FIG. 8 is a perspective view, partially disassembled, of a master case of the apparatus of FIG. 1.
Figure 9:
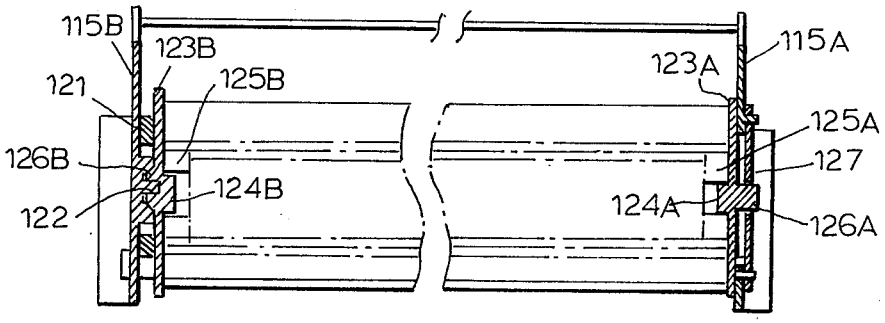
FIG. 9 is a longitudinal sectional view of a unit body containing the master case.
Figure 10:
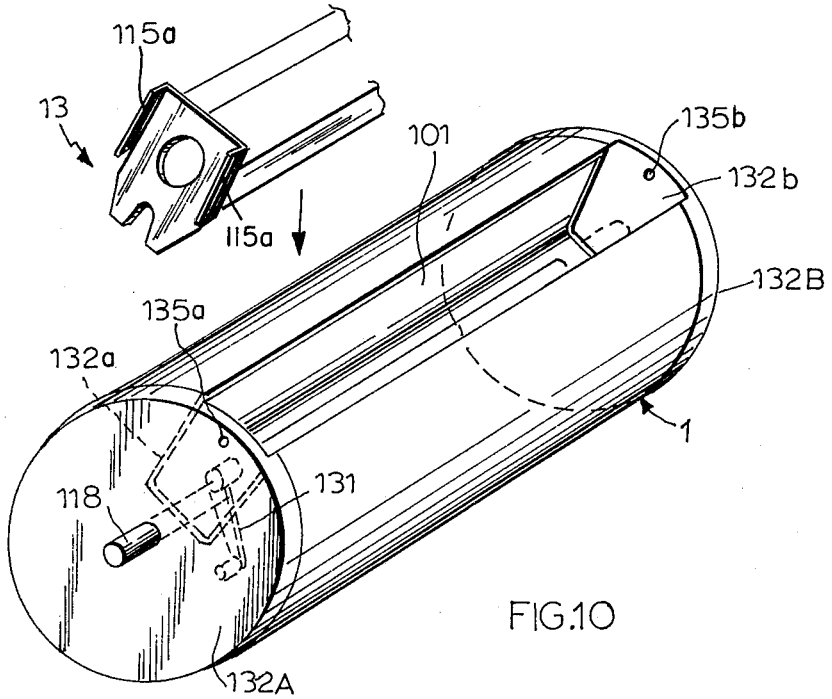
FIG. 10 is a perspective view of a drum adapted to receive the unit body.

Referring now to FIG. 8, there is shown a detailed perspective view, partly in section, of the master case 13 which is removably mounted in the photosensitive body. This mater case 13 has substantially the same length as the body 1, and includes one pair of end brackets 115A and 115B, one pair of side plates 116A and 116B and a connecting rod 117 connecting end brackets 115A and 115B to each other. Engaging grooves 119A and 119B, adapted to engage with the rotary shaft 118 of the body 1, as shown in FIG. 10, are provided at upper end portions of brackets 115A and 115B. An opening 120 is provided in the center of one side bracket 115A, a rubber friction disc 121 is provided in the center of the inner face of the other side bracket 115B, and a stub 122 protrudes inwardly from the center of the disc 121. A photosensitive layer roll supporting mechanism and a photosensitive layer unwinding mechanism are mounted in master case 13. The photosensitive layer supporting mechanism comprises one pair of stub brackets 123A and 123B arranged inside of end brackets 115A and 115B of master case 13. Protruded stubs 124A and 124B are provided on the inner faces of stub brackets 123A and 123B, and comparatively hard rubber cylindrical supporting stubs 125A and 125B are attached to and surround protruded stubs 124A and 124B (refer to FIG. 9). A protruded stub 126A is provided on the outer face of one side stub bracket 123A, and a protruded stub 126B, having a hole therein to receive protruded stub 122 on the inner face of the end bracket 115B, is provided on the outer face of the other side stub bracket 123B. The stub bracket 123A is attached to the master case 13 in such a way that it is made to abut against the inner face of end bracket 115A, and its outer protruded stub 126A is made to protrude through opening 120. A holding plate 127 is mounted onto end bracket 115A from the outside, and central hole 127A of plate 127 is fitted around protruded stub 126A of stub bracket 123A. Engaging holes 127b of plate 127 are fitted around engaging stubs 133 of the end bracket 115A. The stub bracket 123B is attached to the master case 13 of end bracket 115B, and outer protruded stub 126B is fitted around protruded stub 122 of the end bracket 115B. The photosensitive layer unwinding mechanism comprises an unwinding roller 128, a holding roller 129, a supporting roller 130, and a handle 131 to turn unwinding roller 128. Rollers 128, 129 and 130 are rotatively mounted on the end brackets 115A and 115B of the master case 13. End 128a of roller 128 extends outwardly through the end bracket 115A and has a square shape, and the handle 131 has a cavity 131a of a shape corresponding to that of end 128a and is mounted thereon in a freely attachable and detachable manner. Further, the unwinding roll 128 is rotatable only in one direction and rotation in the reverse direction is restrained. When the photosensitive layer roll 102 is to be attached to the master case 13, first the stub brackets 123A and 123B and the holding plate 127 which constitute the supporting mechanism are removed from master case 13 as shown in FIG. 8. Then the stub brackets 123A and 123B are mounted on both ends of the photosensitive layer roll, with the cylindrical supporting stubs 125A and 125B of each stub bracket fitted into the ends of paper tube 102a of the photosensitive layer roll 102. Then this assembly is set in the master case 13 by the operation described above.

As described above, the master case 13 is formed as one unit together with the photosensitive layer roll supporting mechanism and the unwinding mechanism, and this unit is inserted into the photosensitive body 1 from opening 101A, which is provided by cutting away a portion of the peripheral surface of the body 1 at proper width through its whole length as shown in FIG. 10.

Figure 11:
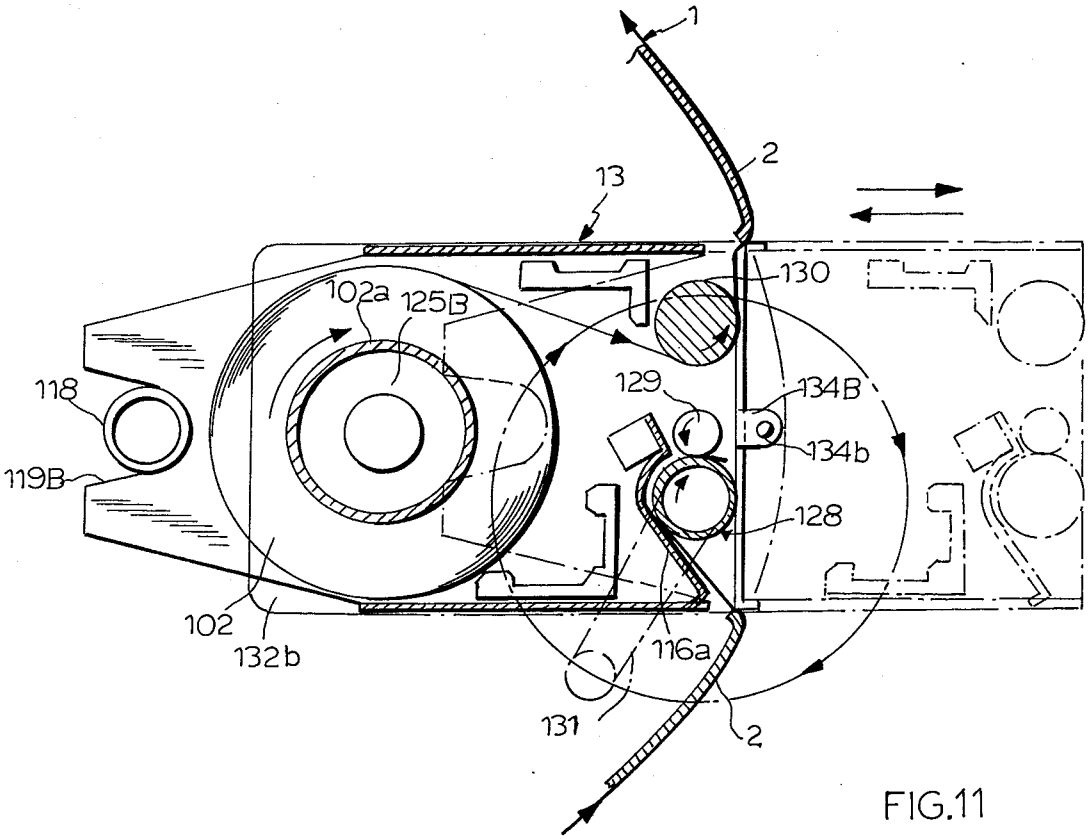
FIG. 11 is a sectional view showing the unit body being connected to the drum.

FIG. 11 shows the position where the unit body receiving the photosensitive layer roll 102 within the master case 13 is set within the body 1, and in this position, the engaging grooves 119A and 119B of the end brackets 115A and 115B of the master case 13 are engaged with the rotary shaft 118 of the body 1, and outwardly folded pieces 115a and 115b of the end brackets 115A and 115B are engaged with and received in engaging grooves 132a and 132b formed on the inner faces of side plates 132A and 132B of the body 1. This master case 13 is fixed to the inside of the body 1 by screws or bolts extended through holes 134a and 134b in attaching pieces 134A and 134B provided at ends of the end brackets 115A and 115B, and holes 135a and 135b provided on the side plates 132A and 132B. Accordingly, when the master case 13 is to be removed from the body 1, master case 13 is removed in the radial direction of the body 1 after removing such screws. When attaching and unwinding of the photosensitive layer 2 is to be performed, the end of the photosensitive layer 2 of roll 102 within the master case 13 is pulled and first wound around the supporting roller 130, is then drawn out of one side edge of opening 101A of the body 1 and wound around peripheral face of the body, then is drawn into the opening 101A from the other side edge thereof, then is passed through the space between the guide plate 116a and the unwinding roller 128, is led through the space between roller 128 and the holding roller 129 while the handle 131 is turned, and is drawn out of opening 101A. When the unwinding roller 128 is driven from this position by turning handle 131, the photosensitive layer 2 is continuously unwound from the roll 102. The end of the photosensitive layer drawn outwardly from the space between the unwinding roller 128 and the holding roller 129 may be properly cut. When a given number of copying operations have been performed, then old photosensitive layer is removed by turning the unwinding roller 128 by the operating handle 131, and new photosensitive layer is placed around the peripheral surface of the body, and the old photosensitive layer is cut off. When the photosensitive layer roll 102 within the master case 13 has been used up, the master case 13 is removed from the body 1, by the operations described above, and the paper tube 102s of the roll is removed from the supporting mechanism, and a new photosensitive layer roll is attached to the supporting mechanism and again positioned within the body 1. Thus, exchange of the photosensitive layer roll 102 can be performed simply and easily by removing the master case 13 to the exterior of the body 1.

Further, although the master case 13 is made to be attached and detached in the radial direction in relation to the body 1 in the above practical example, it may be made to be attached and detached, e.g., in an axial direction of the body, by providing an opening on the side plate at one axial end of the body 1.

As explained above, the master case receiving the photosensitive layer is formed as a single unit together with the supporting mechanism and the unwinding mechanism, and the unit may be removed from the body when it is necessary to exchange the photosensitive layer roll or to inspect or repair the supporting mechanism or the unwinding mechanism. Such removal operation can be performed simply and easily without removing the photosensitive body itself, as is customary in the prior art.

Figure 12:
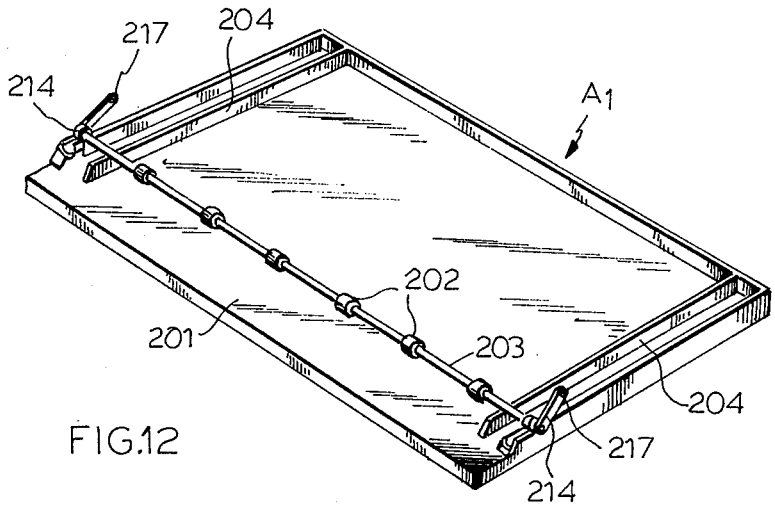
FIG. 12 is a perspective view showing a paper supply apparatus.
Figure 13:
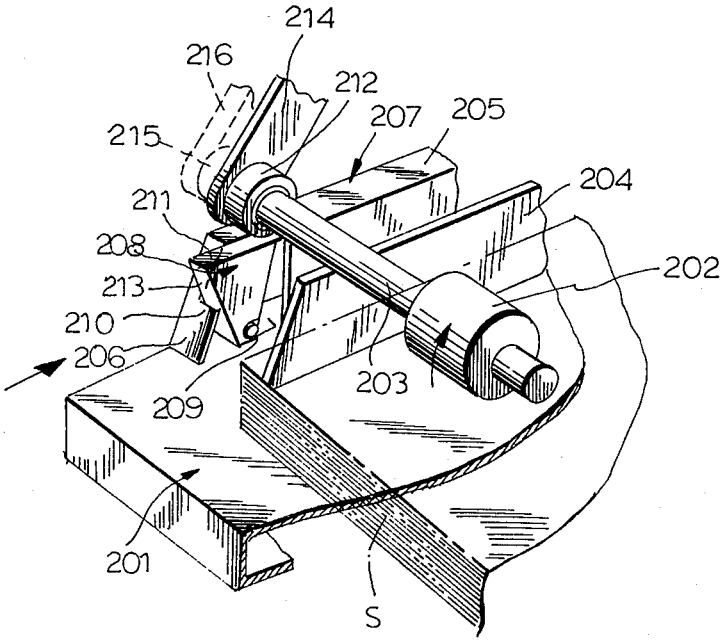
FIG. 13, is an enlarged perspective view in detail of the principal portion of the apparatus of FIG. 12.

In FIG. 1, copying paper supply units $A_1$ and $A_2$ are illustrated as being in the lower portion of the machine body B of the copying apparatus, and the position of one of the copying paper supply units, for example the copying paper supply unit $A_1$, during the insertion of pulling-out thereof is shown in the perspective view of FIG. 12. The copying paper supply unit $A_1$ includes a paper supply table 201 constructed to be inserted in and pulled out from the paper feeding location within the machine body B. A stack of copying paper sheets S rest on table 201, and a plurality of paper supply rollers 202 are adapted to be rotated while in contact with the upper surface of the uppermost copying paper sheet S, to thereby feed the sheet forward, i.e. in the left direction as shown in FIG. 1. The copying paper sheets are thus fed one at a time. Paper supply rollers 202 are secured in spaced relation to the rotary shaft 203. The paper supply table 201 is provided with a pair of side plates 204 which contact the sides of the copying paper sheets S. Furthermore, as shown in FIG. 13, on the paper supply table 201, exterior of each of side plates 204, there are provided guide members 207, each having a horizontal surface 205 and an inclined surface 206. A rocking body 208, of substantially inverted triangular configuration, projects through a side of the upper portion of the inclined surface 206. The lower end of rocking body 208 is mounted on the paper supply table 201 by a spring 209 and is rockable around the lower end. Rocking body 208 projects forwardly from the upper portion of the inclined surface 206 at normal times, as mentioned above, and is engaged by engaging portion 210 of the inclined surface 206 so as not to be allowed to rock forward. The horizontaly surface 205 of the guide member 207 and the upper end surface 211 of the rocking body 208 are disposed to be in the same plane at normal times. On the other hand, guide rollers 212 are mounted rotatably on the end portions of the rotary shaft 203, and each guide roller 212 is adapted to be rolled on the horizontal surface 205 of the guide member 207, the upper end surface 211 of the rocking body 208, the forward inclined surface 213 of the rocking body 208, and the inclined surface 206 of the guide member 207 when the paper supply table 201 is inserted in and pulled out. The rotary shaft 203 is supported for rotation by first ends of rocking levers 214 and is rotated by a pulley 215 provided at one end of the shaft 203 through a belt 216. Each of the rocking levers 214 is rockable about a second end thereof around a fulcrum 217 carried by the machine body B.

The operation of the paper supply apparatus having the construction as described above will now be explained with reference to FIGS. 14(*a*), (*b*) and (*c*).

Figure 14A:
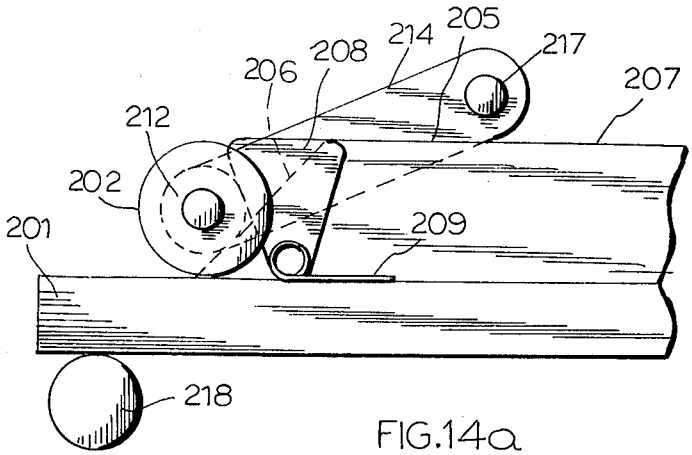
FIGS. 14(*a*), (*b*) and (*c*) are schematic illustrations showing the operation of the paper supply apparatus.
Figure 14B:
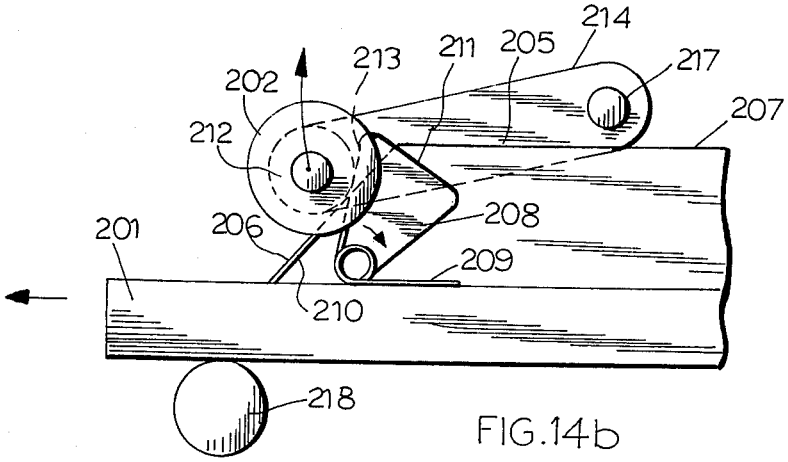
Figure 14C:
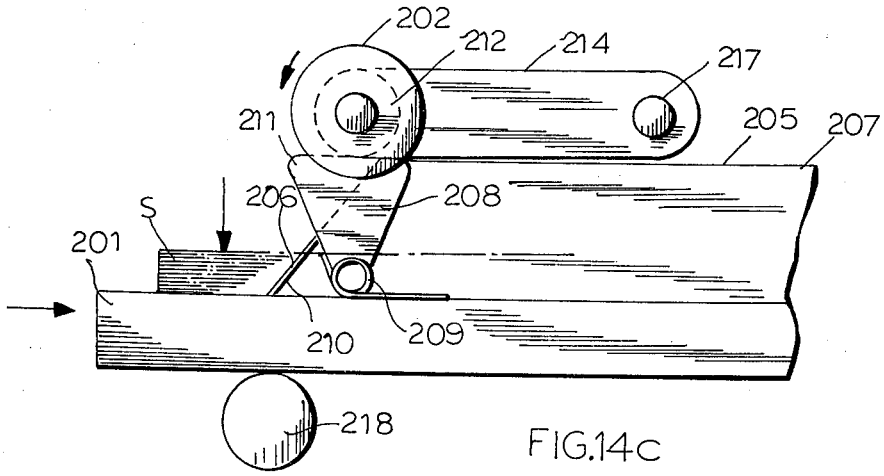

FIG. 14(*a*) shows the position when the paper supply table 201 is inserted and set in the paper feeding location in the machine body B. In this position, at normal times the rollers 202 are operable to supply the copying paper by being contacted against the upper surface of the copying paper, and when the copying paper sheets S are exhausted, each of the paper supply rollers 202 is contacted against the upper surface of the paper supply table 201, and each of the guide rollers 212 is contacted against the inclined surface 206 of the guide member 207.

When the copying paper sheets are exhausted with the apparatus in the paper feeding position shown in FIG. 14(*a*), or when the paper supply table 201 is pulled out for exchanging the copying paper sheets, the guide rollers 212 swing the rocking bodies 208 backward against the biassing force of the springs 209 as shown in FIG. 14(*b*), while rollers 212 are elevated along the inclined surface 206 by the upward rocking of the rocking levers 214 around the fulcrums 217, such that rollers 212 run on the horizontal surfaces 205, whereby the contact between the upper surface of paper supply table 201 and the copying paper S is released and the paper supply table 201 may be pulled out smoothly. Also, the guide rollers 212 run on the horizontal surfaces 205, whereby a copying paper receiving space is formed between the paper supply rollers 202 and the upper surface of the paper supply table 201, so that copying paper sheets may be inserted without completely pulling out the paper supply table 201.

FIG. 14(*c*) shows the position when the paper supply table 201, having been pulled out and having receiving copying paper sheets, is inserted toward the prescribed paper feeding location. When the paper supply table 201 is to be inserted, as the guide rollers 212 are supported on the horizontal surfaces 205 of the guide surfaces 207, each of the paper supply rollers 202 is spaced apart from the upper surface of the stack of copying paper sheets S. Near the end of the insertion of the paper supply table 201, that is, in the position shown in FIG. 14(*c*), the guide rollers 212 move from the horizontal surfaces 205 of the guide members 207 to the upper end surfaces 211 of the rocking bodies 208, and when rollers 212 have passed the upper end surfaces 211, the guide rollers 212 move down toward the paper supply table 201 due to the downward rocking of the rocking levers 214, and the paper supply rollers 202 are contacted against the upper surface of the stack of copying paper sheets S. Thus, when the paper supply table 201 is pulled out or inserted, the paper supply rollers 202 are held apart from the upper surface of the stack of copying paper sheets S by the guide members 207. Numeral 218 in the drawings indicates a roller for supporting and guiding the paper supply table 201.

As described above, in the copying paper supply apparatus, the paper supply table is provided with guide members each having an inclined surface and a horizontal surface, while a rocking body of substantially inverted triangular configuration is provided so as to project at normal times through each inclined surface, whereby when the paper supply table is pulled out from the paper feeding location, guide rollers mounted on the shaft carrying the paper supply rollers run on the horizontal surfaces from the inclined surfaces while making the rocking bodies rock into retracted positions against a biassing force, and the paper supply rollers are rocked around fulcrums to release contact between the paper supply rollers and the copying paper. On the other hand, when the paper supply table is inserted into the paper feeding location, after the guide rollers have passed the horizontal surfaces and the upper end surfaces of the rocking bodies, the guide rollers move down toward the paper supply table, whereby the upper surfaces of the paper and the paper supply rollers are contacted. Thus, setting and exchange of the copying paper may be carried out readily. Also, when the paper supply table is pulled out or inserted, the paper supply rollers do not contact the copying paper except when the paper supply table is in the paper feeding location, and accordingly shifting of the copying paper does not occur during insertion or removal of the table.

Figure 15:
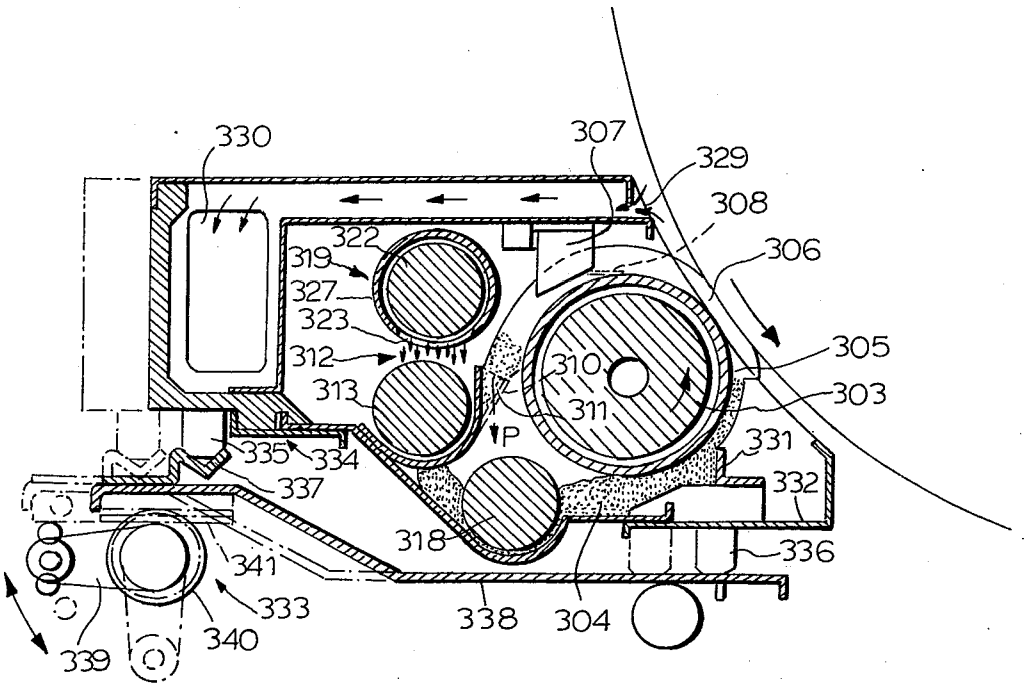
FIG. 15 is an enlarged sectional view of the developing apparatus of FIG. 1.
Figure 16:
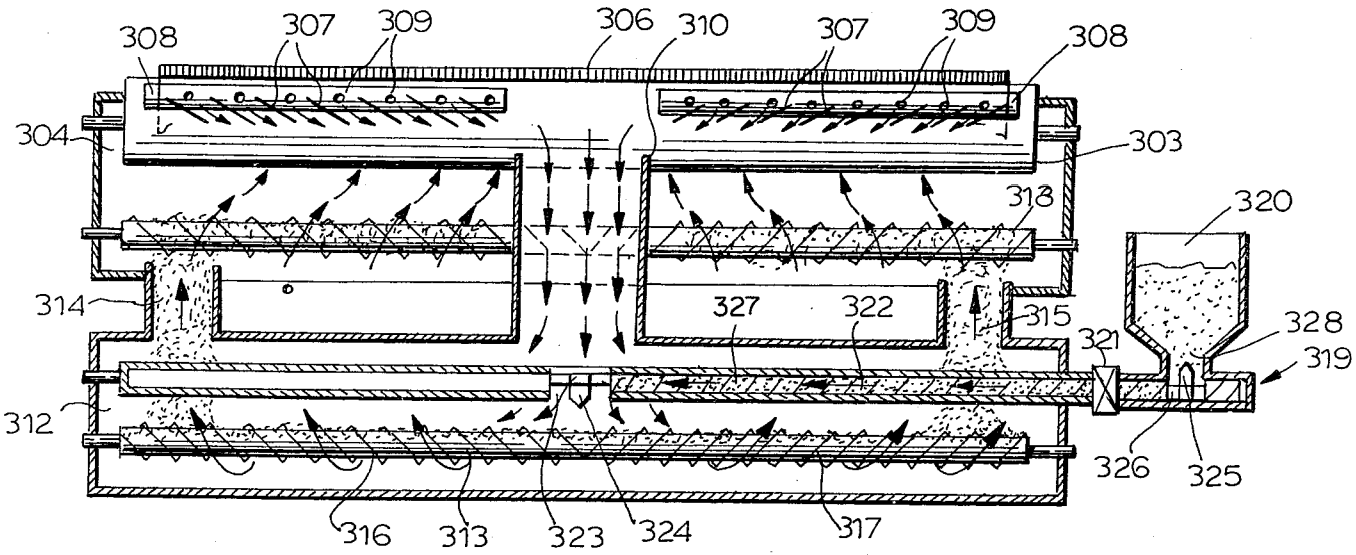
FIG. 16 is a schematic illustration showing the circulating circuit of powder developer in the apparatus of FIG. 15.

Referring now to FIG. 15, there is shown an enlarged sectional view of the developing device 5 wherein numeral 303 is a magnetic brush roller housing a magnet therein and disposed in a developing chamber 304. A magnetic brush 306 of high density and of uniform parallelism is constructed in a desired position on the peripheral surface of the sleeve 305 so as to carry out feasibly close and sure contact with the photosensitive layer 2, and development may be accomplished by attaching electrified toner held by a magnetic carrier to an electrostatic latent image formed on the photosensitive layer 2. Stirring induction plates 307 are positioned closely above the magnetic brush roller 303 and are disposed obliquely toward the middle portion of the magnetic brush roller 303, as shown in FIG. 16, to perform an inducing function as described later. Scratching plates 308 project from the stirring induction plates 307 and operate to scratch off powder developer attached to the magnetic brush roller and consisting of toner and carrier after development by the rotation of the magnetic brush roller 303. The powder developer scratched off from the magnetic brush roller 303 by means of the scratching plates 308 is sent successively to the stirring induction plates 307 by the rotation of the magnetic brush roller 303 and is induced toward the middle portion of the magnetic brush roller 303 while being stirred. Holes 309 are provided in scratching plates 308.

Figure 17:
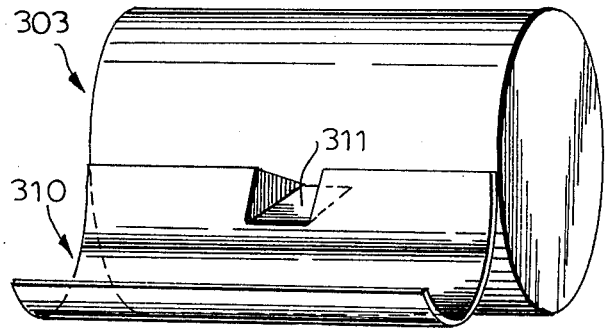
FIG. 17 is a perspective view of the principal portion of the apparatus of FIG. 15.

An exfoliating or removing member 310 is provided for receiving powder developer collected near the middle portion of magnetic brush roller 303 by stirring induction plates 307, as shown in FIG. 17. An extreme outer portion of a projection 311 of member 310 is positioned close to the peripheral surface of the magnetic brush roller 303 and removes the powder developer by the rotation of the magnetic brush roller 303. A stirring chamber 312 stirs the powder developer received by the member 310 and is constructed such that in the stirring chamber 312 there is provided a rotatable sitrring roller 313 which stirs and successively discharges powder developer, fed near the middle portion of the stirring chamber 312, through developer discharging ports 314 and 315 provided at opposite ends of the stirring chamber 312. In the illustrated embodiment, the sitrring roller 313 is provided with spiral grooves 316 and 317 formed to extend in opposite directions in the left and right sides of roller 313. A developer supply roller 318 supplies the powder developer which is discharged from discharging ports 314 and 315 and the powder developer which is fed directly from the magnetic brush roller as shown by arrow P in FIG. 15 to magnetic brush roller 303, while inducing the powder developer toward the middle portion of roller 303.

A supply apparatus 319 supplies fresh toner near the middle portion of the stirring chamber 312. The toner is supplied from an exchangeable toner bottle 320 into the stirring chamber 312 through a toner supply quantity regulating valve 321, a tonner supply screw conveyor 322, and a toner supply port 323 opening into the middle portion of the stirring chamber 312. Toner supply oscillating blocks 324 and 325 ensure a smooth supply of toner and are formed with plate springs fixed to the driving shaft 326 of the toner supply screw conveyor 322. The oscillating blocks 324 and 325 are forcedly elastically deformed by the peripheral wall of the pipe 327 in which the toner supply screw conveyor 322 is inserted. However, at open portions of the peripheral wall, that is at the toner inducing port 328 and the toner supply port 323, the elastic deformation forcedly caused by the peripheral wall is released. At these positions, the toner is suddenly released, and the supply of toner is sure. An air duct port 329 is provided for sucking in any toner scattered at the time of development, and the toner sucked in together with air from the air duct port 329 is collected in dust collecting room 330. A spike or bristle cutting plate 331 is provided for regulating the length of the spikes of the magnetic brush 306. A groove 332 receives the powder developer dropping down at the time of development and extends throughout the entire width of the magnetic brush roller 303.

A shifter 333 is provided for pulling apart the development device from the photosensitive body 1, since poor results may occur if the photosensitive layer 2 is deteriorated when the developing device is pulled out with the magnetic brush 306 contacted against the photosensitive layer 2. At the time of idle running, when only the supply of the toner and the stirring of the developer are carried out, it is necessary to pull apart the developing device from the photosensitive layer, and in this case also, the shifter 333 is operated. The shifter 333 will be explained in detail with reference to FIG. 15. The basic frame 334 of the developing device is constructed so that it may be pulled out together with legs 335 and 336 formed of electric insulating material, and also may be shifted to the left and right by means of shifting base 338 constructed to be movable leftwardly and rightwardly in the drawing. To pull out the developing device, a lever 339 is turned to the position shown by dashed lines, and pinion 340 is rotated to shift leftwardly a rack 341 meshed with the pinion 340. Thus, shifting base 338 secured to the rack 341 is moved to the position shown by dashed lines. At this time, as the guide 337 secured to the shifting base 338 is moved leftwardly while holding the leg 335 secured to the basic frame 334, the developing device is shifted leftwardly. Then, the developing device may be pulled to the side while guiding the leg 335 with the guide 337.

In the construction mentioned above, development is carried out by the magnetic brush roller 303, the powder developer consumed of toner is scratched off from the magnetic brush roller 303 by the scratching plates 308, and the powder developer thus scratched off is stirred while being moved toward the middle portion of the magnetic brush roller 303 by the stirring inducation plates 307. The powder developer moved to the middle portion is removed from the magnetic brush roller 303 by the member 310 and is conveyed substantially to the middle portion of the stirring chamber 312. The powder developer consumed partially of toner and unused brush toner supplied from the toner supply screw conveyor 322 are discharged by the stirring roller 313 to the supply roller 318 from the developer discharging ports 314 and 315 provided at opposite ends of the stirring chamber 312 while being stirred within the stirring chamber 312. The powder developer is supplied to magnetic brush roller 303 while being moved toward the middle portion thereof by the supply roller 318.

The developing device mentioned includes a circulating circuit wherein development is carried out, a part of the developer consumed of toner is transferred to the stirring chamber and mixed with fresh toner supplied thereto, and the mixed powder developer is supplied to the magnetic brush roller while being sufficiently stirred along a relatively long path, so that it is possible to carry out proper development without causing any irregular development even in a relatively larger magnetic brush developing device having a wide magnetic brush roller.

Figure 18:
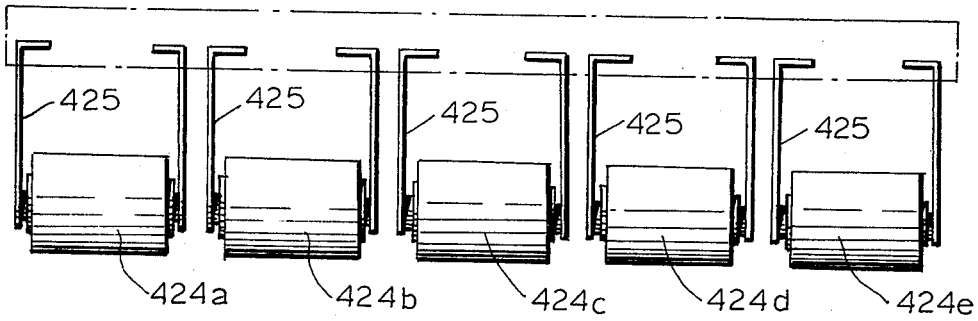
FIG. 18 is a simple schematic illustration showing the arrangement and constitution of lamps in the apparatus of FIG. 1.
Figure 19:
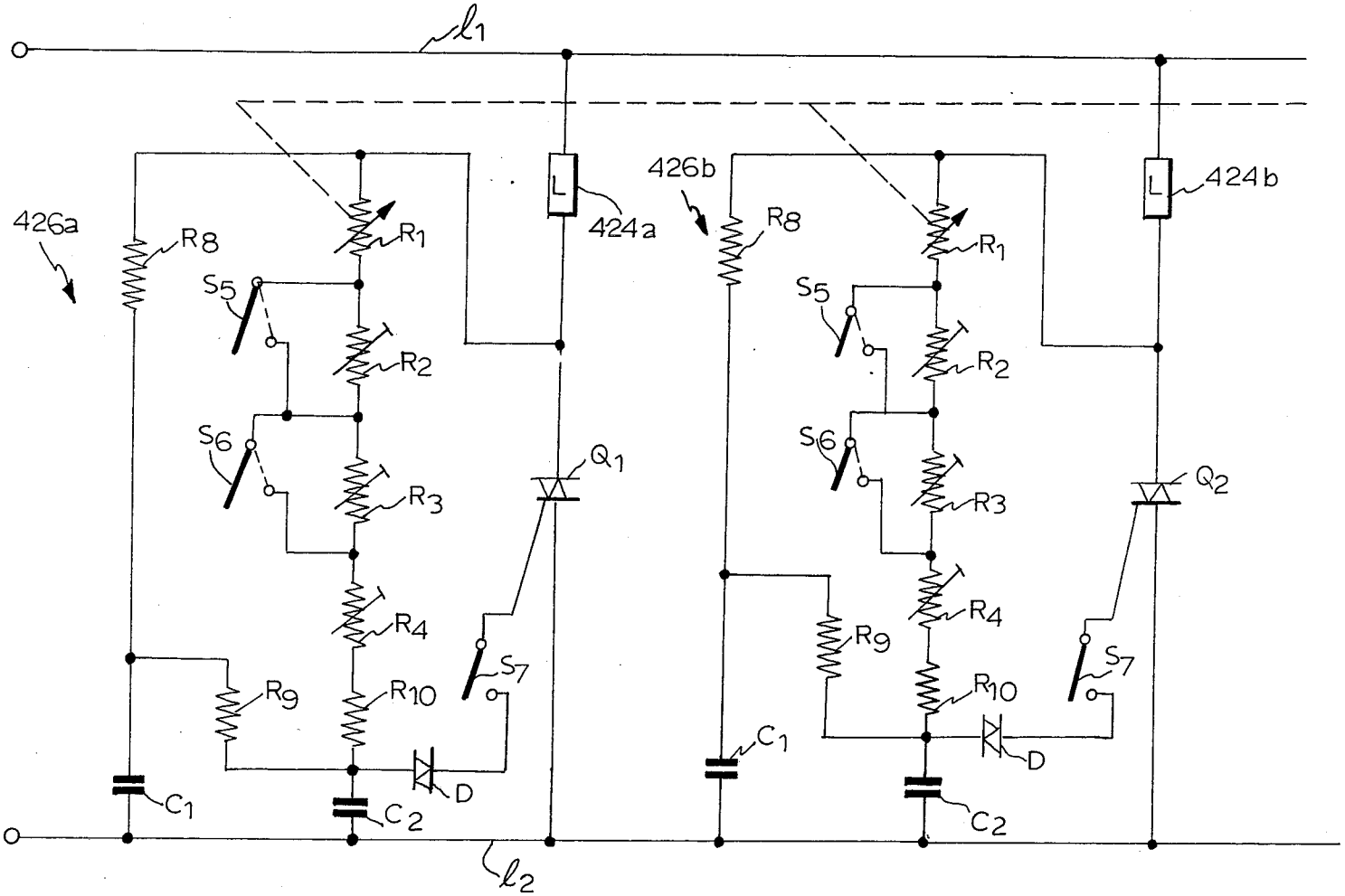
FIG. 19 is an electric circuit diagram showing light-adjusting means fo the lamps in detail.

The light source 28 used in the electrostatic photographic machine of the invention is constituted by a plurality of short length lamps (e.g. halogen lamps) 424*a*, 424*b* . . . , arranged in series as shown in FIG. 18. Opposite ends of each of the lamps 424*a*, 424*b* . . . are supported by supporting metal fittings 425 of good electric conductivity, and each of these supporting metal fittings 425 serves both as a support and a power supplying conductor. Each of the lamps 424*a*, 424*b* . . . is connected with a light-adjusting means 426*a*, 426*b* . . . through the supporting metal fitting 425, as shown in FIG. 19. Thus, lamps 424*a*, 424*b* . . . are adapted to be adjustable to provide a desired exposure individually. In FIG. 19, numerals $1_1$, $1_2$ are electric source lines, $Q_1$, $Q_2$ . . . are TRIAC (triode AC semiconductor switch), and R1 are adjustable resistors for adjusting exposure, with the R1 of each light-adjusting means 426*a*, 426*b* . . . connected to cooperate with each other. R2 are adjustable resistors for adjusting for no-magnification or reduced-magnification, R3 are adjustable resistors for adjusting for each lamp, R4 are adjustable resistors for adjusting for unevenness of the lamps, S5 are changing switches for no-magnification or reduced-magnification, S6 are adjusting and changing switches, S7 are lamp-lighting switches connected to cooperate with each other, R8, R9 and R10 are fixed resistances, C1 and C2 are condensers, and D are varisters.

Further, in FIG. 19 the light-adjusting means of lamps other than lamps 424*a* and 424*b* are not shown, but are constructed of circuits similar to those of light-adjusting means 426*a* and 426*b* and are connected to electric source lines $l_1$ and $l_2$.

In this arrangement, when lighting switch S7 for light-adjusting means 426*a* is closed, a voltage determined by the composite resistance value of resistances R1, R2 . . . and the composite capacitance of condensers C1 and C2 is applied to the gate of TRIAC $Q_1$. TRIAC $Q_1$ is then energized every half cycle of the voltage of the electric source at a phase angle corresponding to the gate voltage, and voltage is applied to lamp 424a, and as a result lamp 424a is lighted. In this case, the luminous quantity displayed by lamp 424a is proportional to the gate voltage of TRIAC $Q_1$.

Lighting of the other lamps is similar to that of 424a. Namely, each lamp 424b . . . can be lighted by closing the respective lighting switch S7 in the respective light-adjusting means.

According to the above construction, even if the luminous capabilities of lamps 424a, 424b . . . differ from each other due to differences in the manufacture of the lamps, etc., and the amount of exposure light is unbalanced, the luminous outputs of each of lamps 424a, 424b . . . can be varied by varying the respective resistance values by operating the respective adjusting resistors R4 in each light-adjusting means 426a, 426b . . . and by thus varying the gate voltage of each TRIAC $Q_1$, $Q_2$ . . . , whereby imbalances can be corrected to provide even exposure simply and exactly. Due to this feature, it is unnecessary to apply strict standards during the selection of the lamps themselves, thus providing more freedom of selection.

On the other hand, when unevenness exists at the original paper side, the luminous capabilities of lamps 424a, 424b . . . can be adjusted by operating adjusting resistors R3 in each light-adjusting means 426a, 426b . . . and by adjusting changing switches S6, and by thus varying the gate voltage of each TRIAC $Q_1$, $Q_2$ . . . in a manner similar to the above description, whereby an even copy can be gained without any problem. Further, in this case, adjusting resistor R3 is operated after switch S6 is in the "OFF" state shown by the solid line in FIG. 19. Further, a phenomenon such as one side unevenness can be prevented by simply operating each resistor R3 and switch S6 so as to be properly adjusted.

Further, with respect to a potential problem due to a difference in light quantity which is apt to occur if copying with no-magnification or reduced-magnification, such problem can be corrected simply by operating no-magnification or reduced-magnification adjusting resistor R2 and switch S5.

Further, since in the above arrangement a multiple number of lamps are used, there is the benefit that, in addition to the above features, when one lamp becomes useless, such lamp may be exchanged, and the expense when only one lamp needs exchanging is less than when it is necessary to exchange all lamps. Also, greater useful lamp life as a whole is obtained, compared with the prior art arrangement wherein only one long lamp is used.

In the above explanation, each resistor R1, R2, R3, R4 and related switches S5, S6 are selectively combined corresponding to the desired use and purpose of the copying machine. For example, such a combination as follows can be considered:

1. No-magnification or reduced-magnification adjusting resistor R2; 2. each lamp adjusting resistor R3; 3. lamp unevenness adjusting resistor R4; 4. exposing adjusting resistor R1 and no-magnification or reduced-magnification adjusting resistor R2 and its changing switch S5; 5. exposing adjusting resistor R1 and each lamp adjusting resistor R3 and its changing switch S6; 6. exposing adjusting resistor R1 and lamp unevenness adjusting resistor R4; 7. exposing adjusting resistor R1 and no-magnification or reduced-magnification adjusting resistor R2 and its changing switch S5 and each lamp adjusting resistor R3 and its changing switch S6; 8. exposing adjusting resistor R1 and no-magnification or reduced-magnification adjusting resistor R2 and its changing switch S5 and lamp adjusting unevenness adjusting resistor R4; 9. exposing adjusting resistor R1 and each lamp adjusting resistor R3 and its changing switch S6 and lamp unevenness adjusting resistor R4; 10. no-magnification or reduced-magnification adjusting resistor R2 and its changing switch S5 and each lamp adjusting resistor R3 and its changing switch S; 11. no-magnification or reduced-magnification adjusting resistor R2 and its changing switch S5 and lamp unevenness adjusting resistor R4; 12. each lamp adjusting resistor R3 and its changing switch S6 and lamp unevenness adjusting resistor R4; etc.

Accordingly, an imbalance in the amount of light exposure due to error in manufacture of the lamps can be corrected to ensure even exposure by the lamp unevenness adjusting resistor R4, and severe manufacturing standards are not necessary during selection of the lamps. Even when uneven original paper having a partially faded portion is used as copying paper, an even copy can be obtained by each lamp adjusting resistor R3. Also, a difference in the quantity of light during no-magnification or reduced-magnification copying can be corrected by the no-magnification or reduced-magnification adjusting resistor R2.

Further, it is unnecessary to re-adjust the volume after every change between ordinary original paper and special original paper, such as partially faded original paper, and between no-magnification and reduced-magnification copying by changing of each lamp adjusting resistor R3, no-magnification or reduced-magnification adjusting resistor R2 and changing switches S5, S6. Moreover, operation is very convenient when changing switches S5, S6 . . . are made to be changed in cooperation with each other.

In summary of the above description, the exposing apparatus in the copying machine according to the present invention includes a light source, for irradiating original paper, composed of multiple lamps in series. The quantity of exposure light of the lamps is adjustable individually by providing a light-adjusting means for each lamp, and accordingly prior art defects are avoided.

We claim:

1. An electrostatic photographic copying apparatus comprising:

a rotatable photosensitive body having on the surface thereof a layer of photosensitive material;

changing means positioned adjacent said body for charging said layer;

optical system means for projecting an image from original paper onto said layer after said layer is charged by said charging means;

means for conveying original paper past said optical system means, said conveying means including an original paper carrying passage, an original paper inlet for introducing original paper into said original paper carrying passage, first original paper outlet means for discharging original paper in a first direction from said original paper carrying passage, and second original paper outlet means for discharging original paper in a second direction from said original paper carrying passage;

developing means positioned adjacent said body for developing said image on said layer;

supply means for supplying copying paper to a position adjacent said body after said image has been developed by said developing means;

transfer means positioned adjacent said body for transferring said image from said layer to said copying paper;

fixing means for fixing said image on said copying paper;

first and second oscillating bodies having passages extending therethrough, said first and second bodies being oscillatable between respective first positions thereof, whereat said passages thereof are aligned, and respective second positions thereof, whereat said passages thereof are not aligned;

said passages of said first and second bodies, when said first and second bodies are in said respective first positions thereof, forming a copying paper carrying passage having a first end extending from said fixing means and a second end;

first copying paper outlet means for discharging copying paper from said second end of said copying paper carrying passage in a first direction, when said first and second bodies are in said respective first positions thereof;

second copying paper outlet means for discharging copying paper from said fixing means in a second direction when said first and second bodies are in said respective second positions thereof;

original paper outlet changing means for selectively controlling which of said first or second original paper outlet means is operable to discharge original paper from said original paper carrying passage;

copying paper outlet changing means for selectively opening or closing said second copying paper outlet means; and said first and second oscillating bodies, said original paper outlet changing means, and said copying paper outlet changing means being interconnected such that when said first and second bodies are in said respective first positions thereof said original paper outlet changing means is positioned to discharge original paper from said first original paper outlet means and said copying paper outlet changing means is positioned to allow said copying paper to pass through said copying paper carrying passage and be discharged through said first copying paper outlet means, and such that when said first and second bodies are in said respective second positions thereof said original paper outlet changing means is positioned to discharge original paper from said second original paper outlet means and said copying paper outlet changing means is positioned to discharge copying paper from said second copying paper outlet changing means, whereby the paths of travel of the original paper and copying paper within the copying machine may be selectively altered without intersection of said paths.

2. An apparatus as claimed in claim 1, further comprising a first original paper receiver positioned adjacent said first original paper outlet means for receiving original paper discharged therefrom, and a first copying paper receiver positioned adjacent said first copying paper outlet means for receiving copying paper discharged therefrom.

3. An apparatus as claimed in claim 2, further comprising a second original paper receiver positioned on said first oscillating body for receiving original paper discharged through said second original paper outlet means, and a second copying paper receiver positioned on said second oscillating body for receiving copying paper discharged through said second copying paper outlet means.

4. An apparatus as claimed in claim 3, wherein said second original paper receiver and said second copying paper receiver are retractably attached to said first and second oscillating bodies, respectively.

5. An apparatus as claimed in claim 1, wherein said original paper carrying passage includes a normal image carrying passage extending from said original paper inlet to said first and second original paper outlet means, and a reverse image carrying passage branching from said normal image carrying passage and extending to a reverse image original paper outlet, and further comprising carrying passage changing means for selectively guiding original paper from said original paper inlet through one of said normal image carrying passage or said reverse image carrying passage.

6. An apparatus as claimed in claim 5, wherein said optical system comprises a light source, a first irradiating opening in said normal image carrying passage, a second irradiating opening in said reverse image carrying passage, means for selectively passing light from said light source to said first or second irradiating openings, and means for selectively opening or closing the optical paths of irradiated light from said first and second irradiating openings.

7. An apparatus as claimed in claim 6, wherein said carrying passage changing means comprises an angle-shaped member fixed to a rotatable shaft.

8. An apparatus as claimed in claim 6, wherein said light passing means comprises a reflecting member having a circular arc shaped configuration and mounted for rotation about said light source.

9. An apparatus as claimed in claim 6, wherein said opening or closing means comprises a pivotally mounted member having on one surface thereof a reflecting mirror and on an opposite surface thereof a shielding plate.

10. An apparatus as claimed in claim 6, wherein said light passing means and said opening or closing means are operatively connected to be simultaneously operable.

11. An apparatus as claimed in claim 1, further comprising a master case removably mounted within said photosensitive body, supporting means attached to said master case for supporting therein a roll of said photosensitive material, and unwinding means supported by said master case for selectively unwinding said photosensitive material from said supporting means, whereby said layer of photosensitive material on said surface of said photosensitive body may be selectively replaced.

12. An apparatus as claimed in claim 11, wherein said master case comprises first and second end brackets connected by a pair of side plates and a connecting rod, each of said end brackets having therein an engaging groove receiving a rotary shaft of said photosensitive body, said first end bracket having an opening therein, and said second end bracket having on the inner face thereof an annular friction disc and a stub protruding inwardly through said disc.

13. An apparatus as claimed in claim 12, wherein said supporting means comprises first and second stub brackets positioned within and adjacent said first and second end brackets, respectively, first and second inner stubs extending inwardly from said first and second stub brackets, respectively, first and second annular supporting stubs surrounding said first and second inner stubs, respectively, first and second outer stubs extending outwardly from said first and second stub brackets, respectively, and said second outer stub having therein a hole receiving said stub protruding inwardly from said inner face of said second end bracket.

14. An apparatus as claimed in claim 12, wherein said unwinding means comprises an unwinding roller, a supporting roller and a holding roller extending between and rotatably supported by said first and second end brackets, and a handle detachably mounted on an end of said unwinding roller.

15. An apparatus as claimed in claim 1, wherein said copying paper supply means comprises a supply table having a surface for the receipt thereon of a stack of copying paper sheets, said supply table being mounted for sliding movement between a paper supply first position and paper replacement second position, at least one paper supply roller mounted on a shaft for rotation in contact with an uppermost sheet of a stack of sheets on said supply table to remove said uppermost sheet from said stack and supply said uppermost sheet to said position adjacent said photosensitive body, at least one guide member mounted on said supply table adjacent at least one lateral side of a stack of sheets positioned on said supply table, said guide member having a horizontal upper surface and an inclined end surface, an oscillating member having a substantially inverted triangular configuration, said oscillating member being pivotally mounted at a lower portion thereof to said supply table to pivot between a first position protruding through said inclined end surface of said guide member and a second position retracted away from said inclined end surface, said oscillating member being normally urged to said first position thereof, a guide roller mounted on said shaft for contact with said guide member and said oscillating member, said guide roller contacting said inclined end surface of said guide member, said paper supply roller contacting said uppermost sheet, and said oscillating member being in said first position thereof when said supply table is in said first position thereof, and when said supply table is moved from said first to said second positions thereof said guide roller is raised up along said inclined end surface, thereby raising said paper supply roller out of contact with said uppermost sheet, while pivoting said oscillating member to said second position thereof, until said guide roller is in contact with said horizontal upper surface of said guide member.

16. An apparatus as claimed in claim 15, further comprising spring means for urging said oscillating member to said first position thereof, and an abutment edge on said inclined end surface for limiting the amount of pivoting movement of said oscillating member to said first position thereof.

17. An apparatus as claimed in claim 15, wherein said shaft is supported at opposite ends thereof by respective first ends of a pair of levers which are pivotally mounted about second ends thereof, and further comprising pulley and belt means attached to said shaft for rotating said shaft.

18. An apparatus as claimed in claim 1, wherein said developing means comprises a rotatable magnetic brush roller positioned adjacent said photosensitive body for developing said image on said photosensitive layer by supplying thereto, during rotation of said brush roller, a powder developer including toner and carrier, stirring induction means positioned adjacent the surface of said brush roller for inducing powder developer remaining thereon after development to be moved to the axial middle portion of said brush roller and for stirring said powder developer in cooperation with said brush roller, means for removing said powder developer moved to said axial middle portion of said brush roller, a stirring chamber positioned to receive in an axial middle portion thereof said powder developer from said removing means, stirring roller means positioned within said stirring chamber for stirring said powder developer received therein from said removing means and for discharging said powder developer from said stirring chamber through discharge ports located adjacent opposite axial ends of said stirring chamber, and developer supply roller means for receiving said powder developer from said discharge ports and for supplying said powder developer to said magnetic brush roller adjacent the axial middle portion thereof.

19. An apparatus as claimed in claim 18, further comprising toner replenishing means for supplying new toner to said powder developer at a substantially central portion of said stirring chamber.

20. An apparatus as claimed in claim 19, wherein said toner replenishing means comprises a toner supply receptacle, a pipe extending from said toner supply receptacle into said stirring chamber, regulating means for adjusting the quantity of toner supplied from said toner supply receptacle into said pipe, a toner supply port in said pipe at a position adjacent said central portion of said stirring chamber, and screw conveyor means in said pipe for conveying toner passed through said regulating means to said toner supply port and into said stirring chamber, whereby said toner is added to said powder developer.

21. An apparatus as claimed in claim 1, wherein said optical system means comprises a light source and means for irradiating light from said light source onto said photosensitive layer, said irradiating means including a lens, a pair of mirrors positioned in planes aligned at a predetermined angle with respect to each other, and means for moving said pair of mirrors as a unit along a plane which bisects said predetermined angle and for thereby adjusting the length of the path of said light.

22. An apparatus as claimed in claim 21, further comprising a first chamber, a second chamber separate from said first chamber and defined by a bulkhead, said light source being positioned within said first chamber, said pair of mirrors being fixed at said predetermined angle to a pair of side plates within said bulkhead of said second chamber, a partition wall connecting said side plates, and wherein said mirror moving means comprises a pair of shafts positioned exterior of respective of said side plates and extending in said plane which bisects said predetermined angle, a first group of brackets fixed to said bulkhead and fixed to said shafts to thereby fixedly position said shafts, a second group of brackets fixed to said side plates and slidably mounted on said shafts, such that said second group of brackets, said side plates and said pair of mirrors are slidable along said shafts, and adjusting bolt means, extending through one of said first group of brackets to an adjacent one of said second group of brackets in a direction parallel to said shafts, for selectively moving said one of said second group of brackets toward or away from said one of said first group of brackets, and for thereby selectively moving said side plates and said pair of mirrors along said shafts in said plane which bisects said predetermined angle.

23. An apparatus as claimed in claim 22, wherein said one of said first group of brackets and said one of said second group of brackets have portions extending through an opening in said bulkhead to the exterior of said second chamber, and said adjusting bolt means is positioned exterior of said second chamber, whereby adjustment of the position of said pair of mirrors may be performed exterior of said second chamber.

24. An apparatus as claimed in claim 23, further comprising graduated indicia means, positioned along an edge of said opening at the exterior of said bulkhead, for indicating the relative position of said pair of mirrors as a function of the relative position of said adjusting bolt means.

25. An apparatus as claimed in claim 1, wherein said optical system means includes a light source comprising a plurality of lamps connected in series, a separate light adjusting means connected to each said lamp for individually selectively adjusting the amount of light emitted by each said lamp.

26. An apparatus as claimed in claim 25, further comprising separate fitting means for supporting each said lamp and for electrically connecting each said lamp to the respective said light adjusting means, each said fitting means being composed of a metal material having a high degree of electrical conductivity.

* * * * *